US006916015B2

(12) United States Patent
Andreasson

(10) Patent No.: US 6,916,015 B2
(45) Date of Patent: Jul. 12, 2005

(54) LIFTING DEVICE

(75) Inventor: Henrik Andreasson, Årjäng (SE)

(73) Assignee: EBL Systems Aktiebolag, Arjang (SE)

( * ) Notice: Subject to any disclaimer, the term of this patent is extended or adjusted under 35 U.S.C. 154(b) by 0 days.

(21) Appl. No.: 10/450,785

(22) PCT Filed: Dec. 20, 2001

(86) PCT No.: PCT/SE01/02851

§ 371 (c)(1),
(2), (4) Date: Jun. 18, 2003

(87) PCT Pub. No.: WO02/49955

PCT Pub. Date: Jun. 27, 2002

(65) Prior Publication Data

US 2004/0108498 A1 Jun. 10, 2004

(30) Foreign Application Priority Data

Dec. 20, 2000 (SE) ..... 0004747

(51) Int. Cl.[7] ..... B66D 1/50
(52) U.S. Cl. ..... 254/270; 254/271
(58) Field of Search ..... 254/269, 270, 254/271–273, 339, 340, 360, 363, 394, 396

(56) References Cited

U.S. PATENT DOCUMENTS

| | | | | | |
|---|---|---|---|---|---|
| 813,451 | A | * | 2/1906 | Rohling et al. | 254/271 |
| 2,989,288 | A | * | 6/1961 | Smith | 254/334 |
| 3,537,686 | A | | 11/1970 | McKendrick | |
| 3,677,520 | A | | 7/1972 | Koomey | |
| 3,850,380 | A | * | 11/1974 | Kranefeld | 254/271 |
| 3,998,432 | A | | 12/1976 | Uldricks et al. | |
| 4,284,253 | A | * | 8/1981 | Uribe | 254/271 |
| 4,448,394 | A | * | 5/1984 | LeMoine | 254/271 |
| 4,455,013 | A | | 6/1984 | Fischer et al. | |
| 5,350,075 | A | | 9/1994 | Kahlman | |
| 5,915,673 | A | * | 6/1999 | Kazerooni | 254/270 |
| 5,984,276 | A | | 11/1999 | Green | |
| 6,299,139 | B1 | * | 10/2001 | Kazerooni | 254/270 |
| 6,386,513 | B1 | * | 5/2002 | Kazerooni | 254/270 |
| 6,622,990 | B2 | * | 9/2003 | Kazerooni | 254/270 |
| 6,634,621 | B2 | * | 10/2003 | Keith | 254/270 |

FOREIGN PATENT DOCUMENTS

| | | |
|---|---|---|
| DE | 23 65 374 | 1/1975 |
| SE | 8502716 A | 1/1986 |
| WO | WO 86/07042 A1 | 12/1986 |

* cited by examiner

*Primary Examiner*—Emmanuel M Marcelo
(74) *Attorney, Agent, or Firm*—Nixon & Vanderhye

(57) ABSTRACT

A lifting device comprising a rope or wire provided at one end with a gripping device for an object to be lifted, a pulling device provided at the other end of the rope or wire and a rope wheel around which the rope or wire is wound. The rope wheel is provided with a groove for the rope. The rope wheel has a bulge in which a raised screw is inserted wherein, when the rope is wound on the rope wheel and reaches the bulge, the rope is lifted and interacts with a breaker, thereby stopping lifting.

13 Claims, 10 Drawing Sheets

LIFTING DEVICE

This application is the U.S. national phase of international application PCT/SEO1/02851, filed 20 Dec. 2001, which designated the U.S.

TECHNICAL FIELD

The present invention relates to a lifting device comprising a rope, wire, or the like, which at one end is provided with a gripping device for the object to be lifted, wherein the rope, wire, or the like, is connected to a pulling device being able to pull the rope and lift the gripping device with adhering load upwards. Such lifting devices are used for instance at air ports to lift luggage but the invention is not limited to only this field of application.

PRIOR ART

Lifting devices for e.g. luggage at air ports are previously known and are used to a certain extent. The device facilitates to a large extent the work in connection with the handling of luggage and is very appreciated by the personnel. It consists of a handle with a hook at the bottom, which is connected to a wire. The wire is actuated by a pneumatic cylinder, which is provided in the ceiling, and through influence of the handle a user can control the hook so it is either lowered or raised. The lifting operation itself is performed by the hook, which is provided on an ergonomically shaped handle, and which is hooked in the handle of the suitcase, whereupon a pressure on one side of a controller on the handle activates the pneumatic cylinder, so that the suitcase is lifted. The operator can then guide the suitcase to the desired position, whereupon he gets the suitcase to be lowered by pushing on the other side of the controller. The whole operation can be performed without any heavy lifts, which results in a substantial reduction of diseases due to wear, which in its turn reduces the absence due to illness.

OBJECTIVES OF THE INVENTION

Even if the known lifting devices as such function well, they, however, suffer from certain drawbacks. In the first place the pneumatic cylinder mechanism, which is used, entails that a large installation dimension is required, as the wire runs entirely inside the cylinder. At a lifting height of for instance two meters, the cylinder must thus also have a length of two meters. As a consequence of this fact, it will be difficult to reach every part of a room provided with such a lifting device. Further, the wire entails wear of seals inside the cylinder, as a very long section of the wire must pass through the seals. This often leads to leakage and an undesired, large maintenance requirement. Further, there is always a risk that the handle or hook will break during the lifting. The wire can then be rapidly snatched upwards, before the air pressure in the cylinder stops the cylinder piston. This can cause damage to the cylinder and its seals. Additionally, the operator himself must determine when the lifting shall be ended. If the operator interrupts the lifting too late, this can lead to the hook turning against the cylinder, which also can lead to detrimental jerks. Therefore, it is a purpose of the invention to provide a lifting device, which requires a small installation area and which involves substantially less maintenance by eliminating leakage because of wear of the seals. Further, it is a purpose to provide a lifting device, where rapid jerks can be avoided and where the lifting device can be forced to start the lifting motion as smooth as possible.

SHORT DESCRIPTION OF THE INVENTION

According to the present invention, the above mentioned objectives are reached, i.a. by providing a lifting device comprising a rope, wire, or the like, which at one end is provided with a gripping device for the object to be lifted, wherein the rope, wire, or the like at the other end is connected to a pulling device, the pulling device being so designed that the rope, when it is pulled up, occupies a considerably shorter length than the distance which the gripping device has been lifted.

According to the invention, it is suitable that the gripping device consists of a hook with an operation handle for the lifting and lowering of the hook.

According to the invention, the pulling device can consist of one or two pneumatic or hydraulic cylinders, which via their end walls are attached to a carrier, which cylinders through their piston rods extending from the second end walls, support a fiddle block, which via the rope interact with the fiddle block attached to the carrier.

Another embodiment of the invention involves that the pulling device consists of an electric motor, which via a transmission is intended to drive a rope wheel, around which the rope, wire, or the like, is wound.

According to an additional embodiment of the invention, the pulling device may consist of a rodless cylinder, on the endless web of which one or more impellers are provided, which are intended via the rope, wire, and the like, to interact with one or more fixed impellers at the cylinder to shorten or lengthen the rope, wire, or the like.

According to the invention, it is suitable that the lifting device is suspended on a system of rails enabling horizontal movement of the lifting device in an optional direction.

In the operation handle according to the invention, valves are suitably provided for the hydraulic and pneumatic drive, or electric adjustment means, or a transmitter for the control of the electric motor.

According to a particularly advantageous embodiment of the invention the lifting device comprises means to automatically interrupt the lifting, independent of the operator, when a predetermined condition has been fulfilled, especially a condition concerning the acceleration of the rope or lifted length. Such means for automatically interrupting the lifting may consist of a locking means, which automatically locks the cylinder piston, if this exceeds a certain speed. Alternatively, such a means may comprise a switch breaking the lifting, when the wire has reached a certain position or when the wire/rope runs off its groove.

DESCRIPTION OF DRAWINGS

Below, the invention will be described more in detail with reference to the enclosed drawings, of which

DETAILED DESCRIPTION

Figure 1:
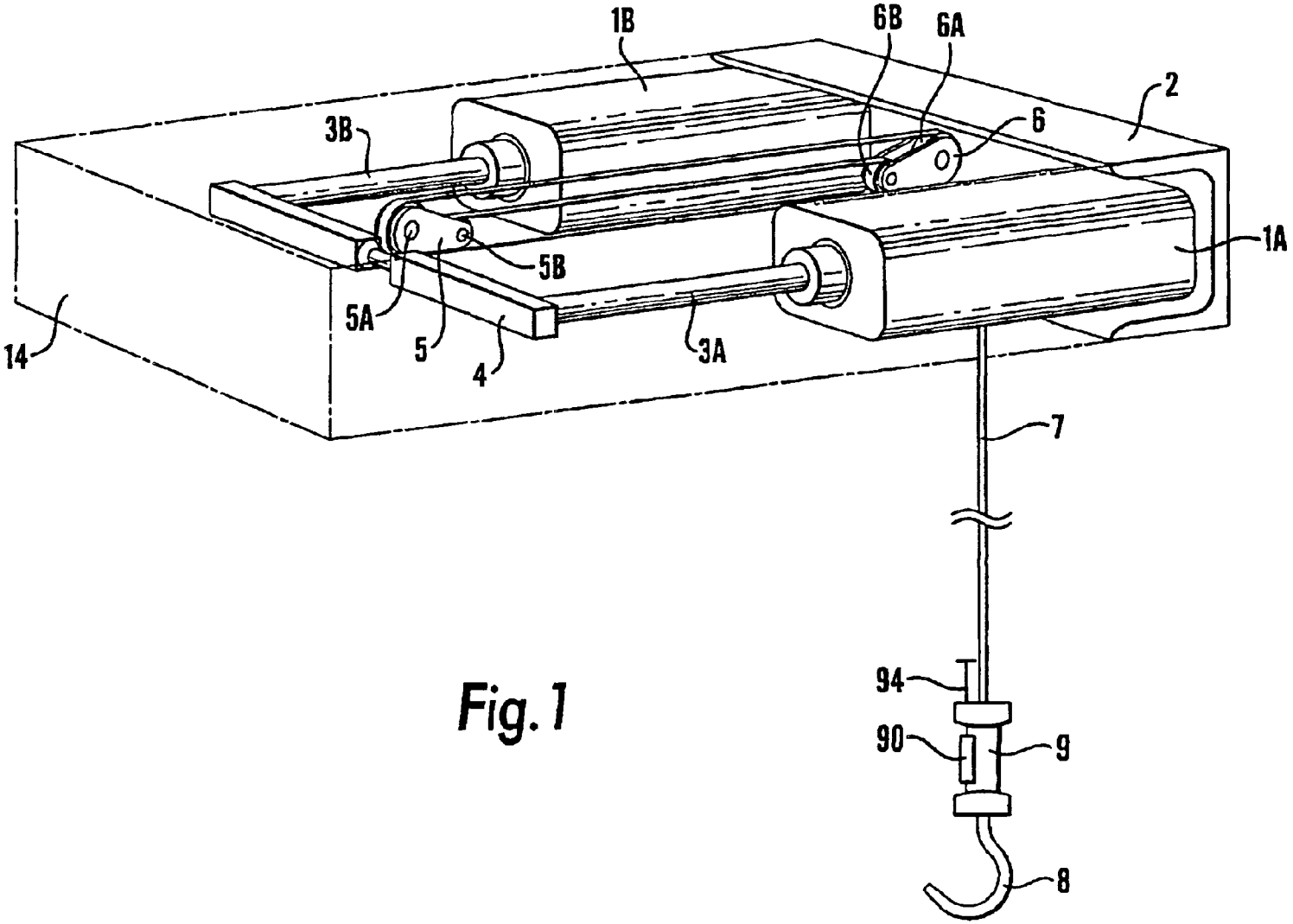
FIG. 1 is a perspective view of a preferred embodiment of the invention.

FIG. 1 shows a lifting device comprising two pneumatic cylinders 1A, 1B, which are welded to or in any other way attached to a basic element 2, suitably a U-beam or L-beam, which can form a suitable support construction to the horizontal cylinders 1A, 1B. Said two pneumatic cylinders (which can also be hydraulic) comprise a piston rod each 3A, 3B extending from the end wall which is not attached to the basic element 2. Said piston rods 3 are joined by a cross bar 4, and a first fiddle block 5 is provided on the cross bar 4 halfway between the piston rods 3A, 3B. The fiddle block 5 consists in a known manner of a large rope wheel 5A and a small rope wheel 5B, which are provided adjacent to each other between two sheet-like side elements, so that the rope can be brought to and fro through the block without bringing the rope parts in the same plane in contact with each other. Said fiddle block interacts with a second fiddle block 6, which is attached to the basic element 2. A rope 7 runs between the two fiddle blocks 5, 6. The rope 7 can be made very short. Often a length of 2 to 3 meters is sufficient. In rare cases, a longer rope can be needed, but more than 5 meters might in principle never be needed. The rope 7 is at one end provided with a handle 9 with a hook 8. The other end of the rope is secured in the second fiddle block 6. The rope 7 runs from the handle 9 up and beyond the large rope wheel 6A of the second fiddle block, further to the first fiddle block 5, around the large rope wheel 5A of the first fiddle block, and then back to the second fiddle block 6, and around its small rope wheel 6B. Then back to the first fiddle block 5, around its small rope wheel 56, and finally the second end of the rope is secured in the second fiddle block 6. Thanks to this arrangement a gear between the two fiddle blocks is created. The cylinders 1A, 1B are preferably provided inside a protected space by the provision of a protecting cover 14 (shown in phantom) around the device. The rope 7 can suitably be a Kevlar rope or a wire. The hook 8 is intended to be hooked on the object to be lifted. The handle 9 comprises a controller 90, which via a conduit 94 controls valves for the pneumatic operation.

The lifting device can also be attached to the ceiling or also be attached to and extending from a wall in different ways. However, it is suitable that the lifting device is provided on a system of rails making the device movable in any optional direction. A suitcase coming on a truck can for instance be lifted therefrom by means of a lifting device which, without any large effort, is pushed over a belt, whereafter the lifting device lowers the suitcase onto the belt. Such a movement of the suitcase requires very little human force.

Figure 2:
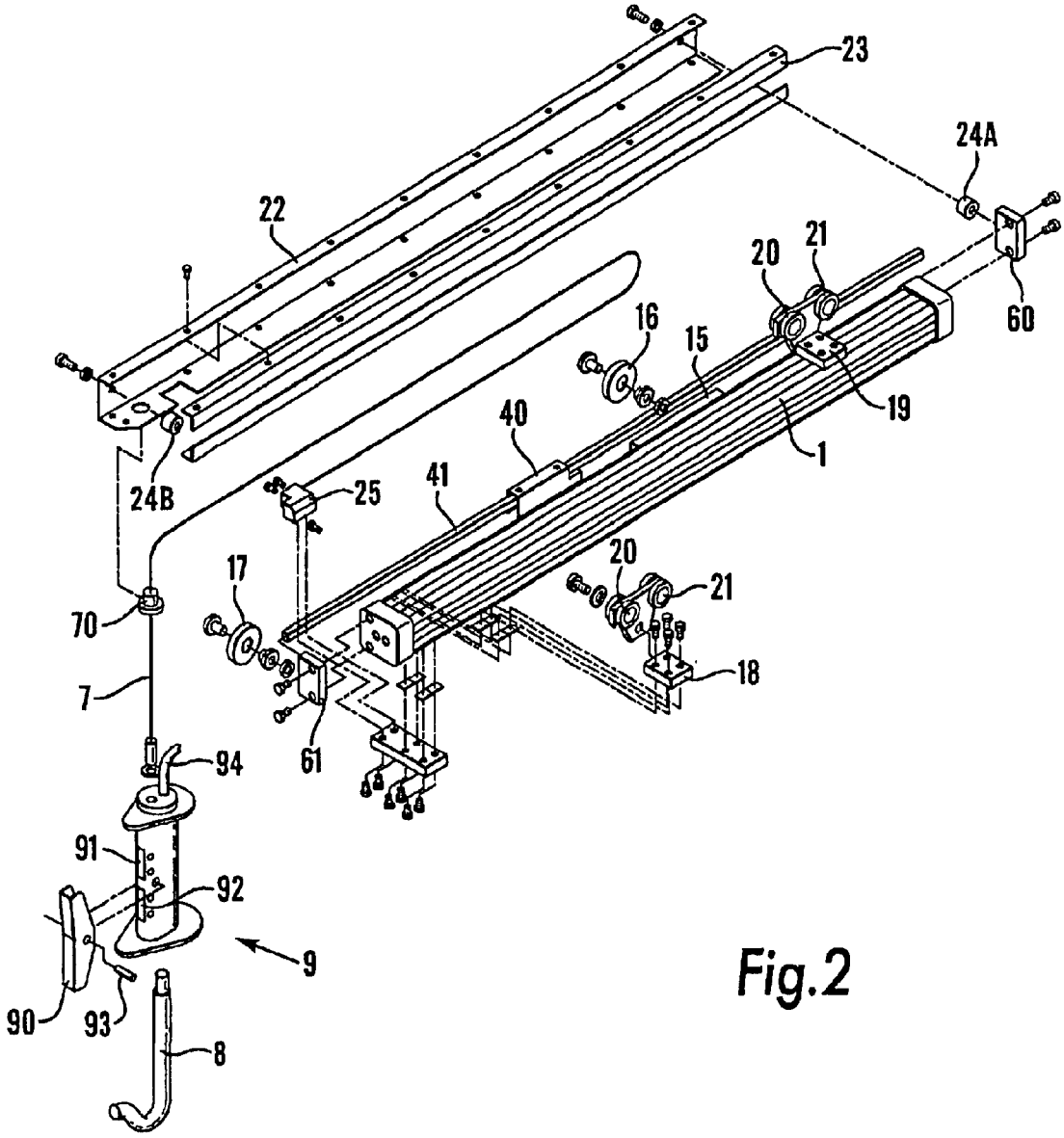
FIG. 2 is an exploded view of a modified embodiment of the present invention.

FIG. 2 is an exploded view of an embodiment, where the pulling device consists of a so called rodless cylinder 1. The rodless cylinder, which is a standard element, consists of a pneumatic unit with a piston (not shown) inside a longitudinal cylinder 1 and an endless belt (not shown) secured in a loop to said piston. At the belt a pulling element 15 is provided on the outside of the cylinder 1, so that the pulling element 16 can be activated to move to and from along the cylinder 1. A first rope wheel 16 is then provided on the pulling element 15. A second rope wheel 17, which is fixedly mounted, is provided at one end of the cylinder 1. The cylinder 1 is provided with two brackets 18, 19. At respective bracket double wheel pairs 20, 21 are provided, so called boogies. Said wheel pairs 20, 21 are intended to be provided inside a rail provided with a slit, so that the entire cylinder 1 can be moved along the rail by the wheels resting and rolling inside the rail, the slit of which is large enough, so that the brackets 18, 19 can protrude therethrough. Said rail (not shown) is in its turn suitably displaceably arranged in an additional rail system, which enables movement of the cylinder in the transverse direction. Further, it is shown that the rope wheels 16, 17, a gear rack 41, and a housing 40 are provided inside a casing 22, 23. At one end of said casing parts 22, stop bushings 24A, 24B are provided in each end thereof to limit the motion of the pulling element 15. At the bottom of the same casing part 22 a nozzle 70 is provided, through which the rope 7 runs. Then the rope runs around the second rope wheel 17 and further around the first rope wheel 16 in order to be fixed inside a stop means 25 with one end, which means is attached to one end of the cylinder 1. The other end of the rope is fixed to the handle 9, which is provided with a hook 8. The handle is provided with a controller 90, which is pivotable around an axis 93. The lower portion of the controller 90 can interact with the first controller 92, and its upper portion with the second controller 91. Through a conduit 94 the signals are transmitted from the controllers to a control unit (not shown), so that the hook can be caused to move upwards when the upper controller 91 is activated and downwards when the lower controller 92 is activated.

Figure 3:
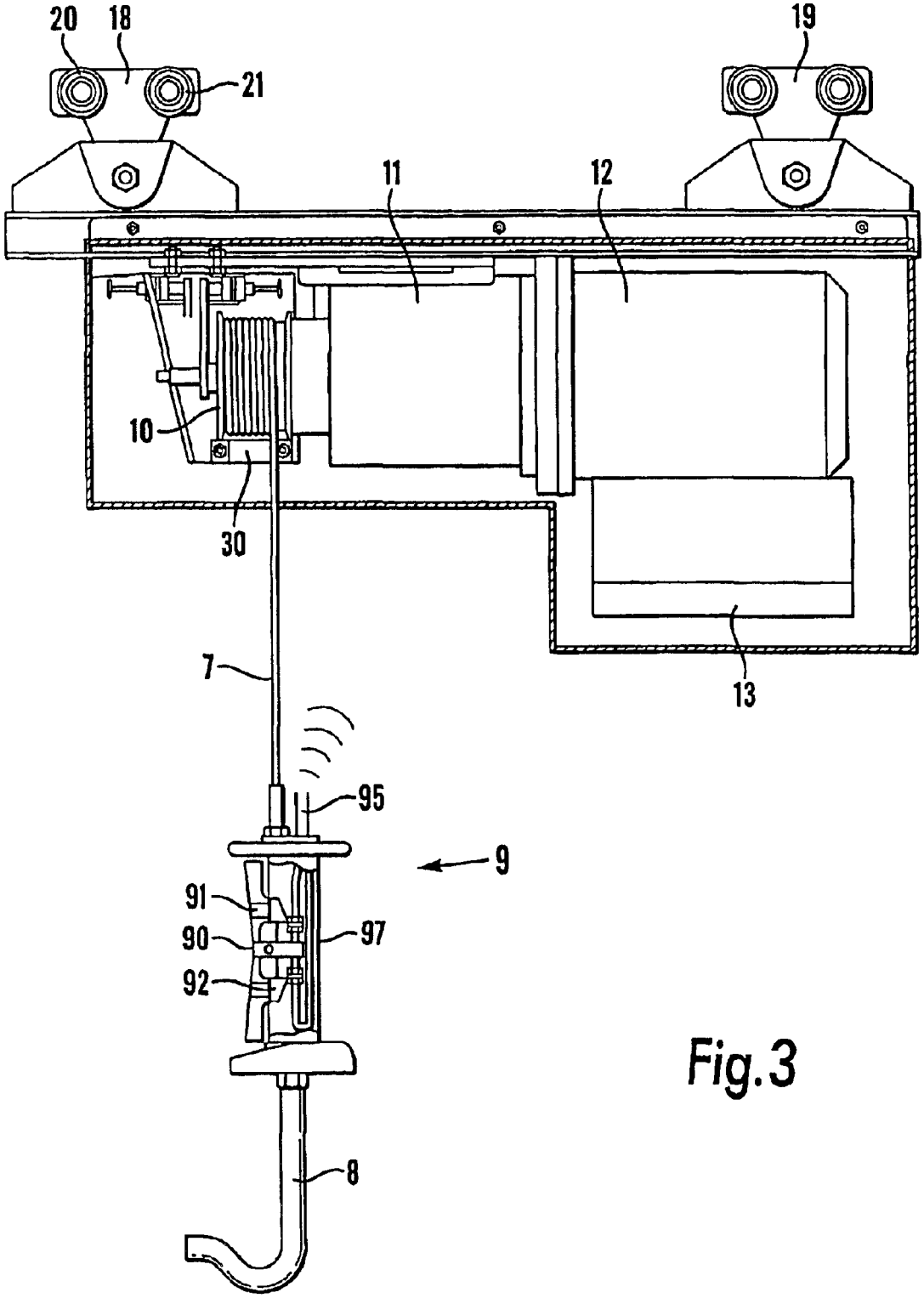
FIG. 3 is a side view, partly in cross-section, of a further modified embodiment of the present invention.

FIG. 3 shows a third embodiment of the present invention. In the figure, the handle 9 is shown in a vertical section. In said section it is shown that the electric controllers 91, 92, 97 are provided inside the handle together with a transmitter 95 for the control of an electric motor 12 via a receiving and control unit 13. In this case, the rope 7 hangs in a rope wheel 10, which in its turn is connected to a transmission 11, which is driven by an electric motor 12. The whole device can run in the horizontal direction by means of boogies 18, 19, 20, 21, which are provided inside rails (not shown). The device functions in principle in accordance with what has been described above with reference to previous figures. A change, compared to the constructions previously shown, is the provision of a safety controller 97. Said safety controller 97 must be closed by pressing so that the impulses to the controllers 91, 92 for the control of the motor 12 could be executed. Thus the lowering and lifting operation, respectively, is interrupted, if the controller 97 is not activated, which i.a. implies the large advantage that a lifting or lowering of the hook 9 cannot take place by mistake, if any of the controllers 91, 92 by accident should be closed. In the simplest design the safety controller 97 consists of two parallel, resilient tinplates, which in inactivated state are at certain distance from each other, and which, when a hand is closed around the handle 9, is compressed, wherein a safety circuit is closed, so that respective circuit for the lifting/lowering function can be activated.

Figure 4:
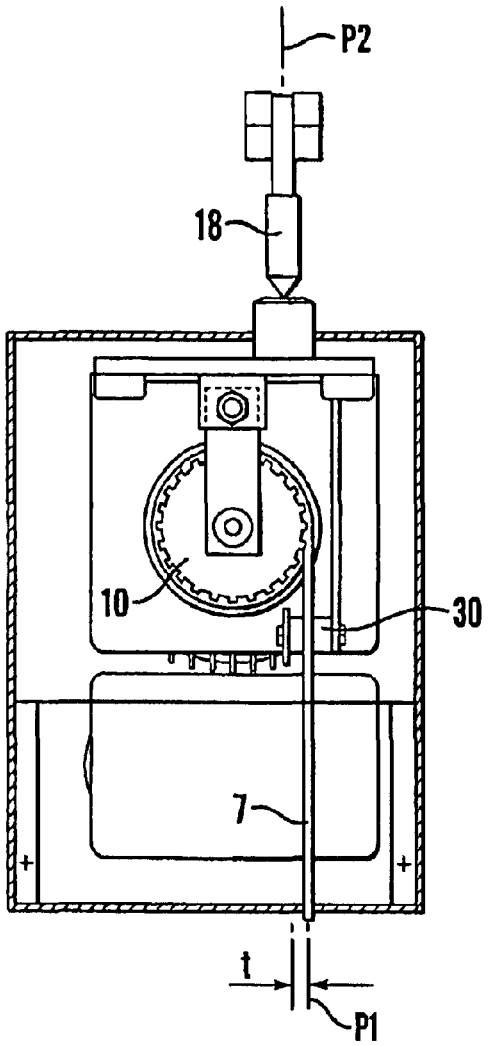
FIG. 4 is a front view of the device according to FIG. 3.
Figure 5A:
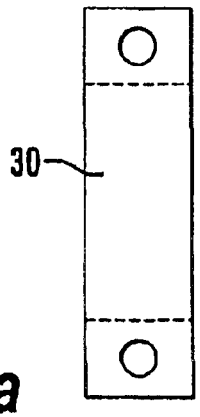
FIGS. 5*a* and 5*b* show in detail a design of a rope guide means in the device shown in FIGS. 3 and 4.
Figure 5B:
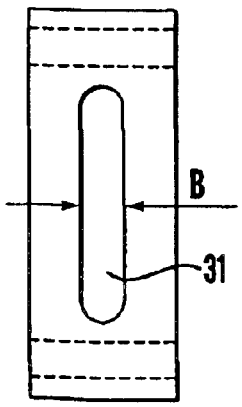

In FIG. 4 a device according to FIG. 3 is shown. 3. As can be seen, the rope 7 runs in a plane P1, which is provided at a short distance from, or coincides with the plane P2, in which the bracket elements 18, 19 for the boogie are provided. According to a preferred embodiment, the distance between P1 and P2 should be between 0 and 10 cm, preferably 0 to 5 cm, and more preferred 0 to 3 cm. Thank to this arrangement, the suspension can be balanced, so that those reaction forces which arise do not bring the device into rotation. Further, it is shown that the rope 7, before it reaches the rope wheel 10, passes through a rope guide 30. Said rope guide (see FIG. 5) consists of a fixed, resistant element 30, inside which there is a slit 31, the width B of which is somewhat larger than the diameter of the rope 7. It is important that the edges of the slit in the rope guide 30 are blunt, so that the rope will not be damaged. Thanks to said rope guide the risk is eliminated that the rope will leap off the rope wheel 10.

Figure 6A:
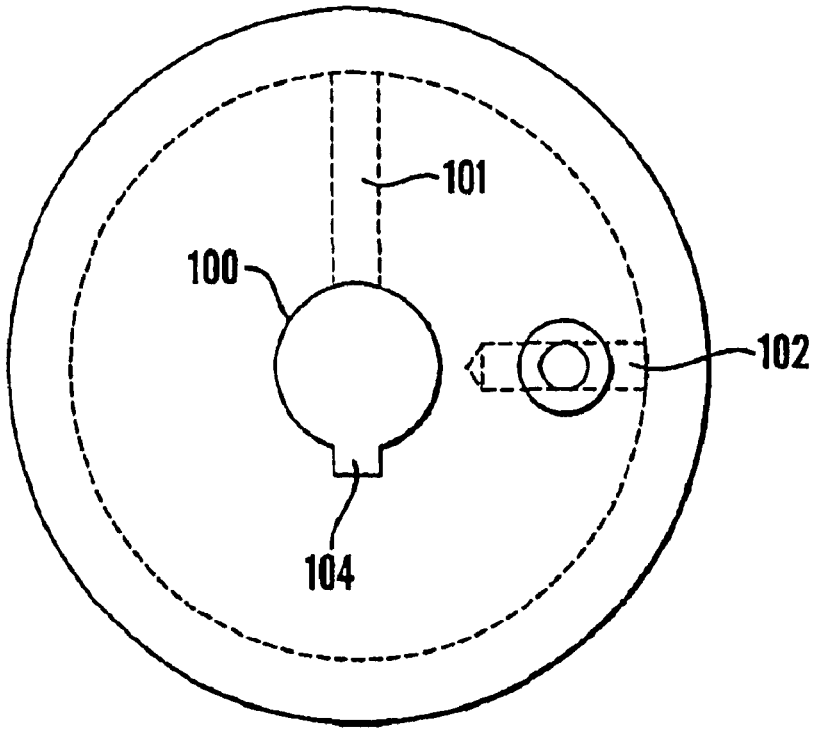
FIGS. 6*a* and 6*b* show a preferred rope wheel of FIGS. 3 and 4.
Figure 6B:
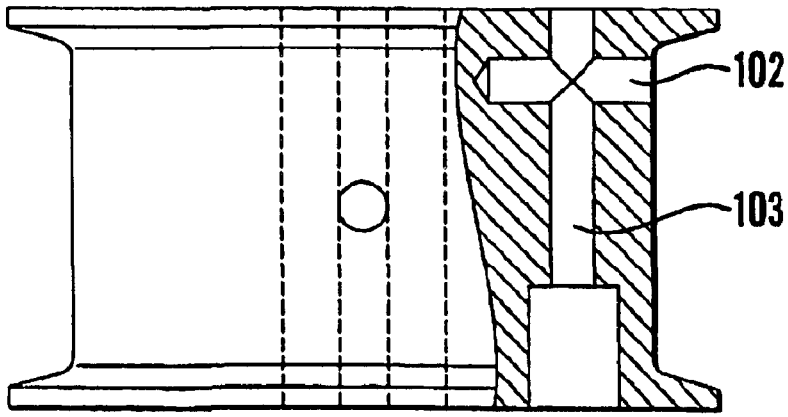

In FIG. 6 a preferred embodiment of a rope wheel 10 according to the invention is shown. As can be seen, the rope wheel 10 is provided with a central aperture 100 and a recess 104 intended for the fixed mounting to the rotating axis of the transmission 11 by means of a key joint. The rope wheel is also provided with a transverse boring 101 intended for the fixed mounting of a wheel on the axis by means of a stop screw or by means of a ball bearing. Further, it is shown that the wheel is provided with a radial boring 102 as well as an axial boring 103 intersecting each other. By means of said borings 102, 103 a simple fixed mounting of the rope 7 at the rope wheel 10 can be achieved by its end being fixed inside the radial boring 102 by means of a screw joint which with its outer end wedges the rope 7 inside the radial channel 102.

According to the present invention, the lifting device can thus be installed with essentially smaller installation dimensions than has hitherto been possible, as the rope or wire in the pulling device is not stretched to its full length but runs to and fro or is wound. The rope or wire does not either run through any pneumatic cylinder and therefore the risk for leakage because of the rope guide does not occur. Thus, the invention does not only save space but provides also an improved action radius and a more reliable mechanism, the maintenance of which being low.

Figure 7:
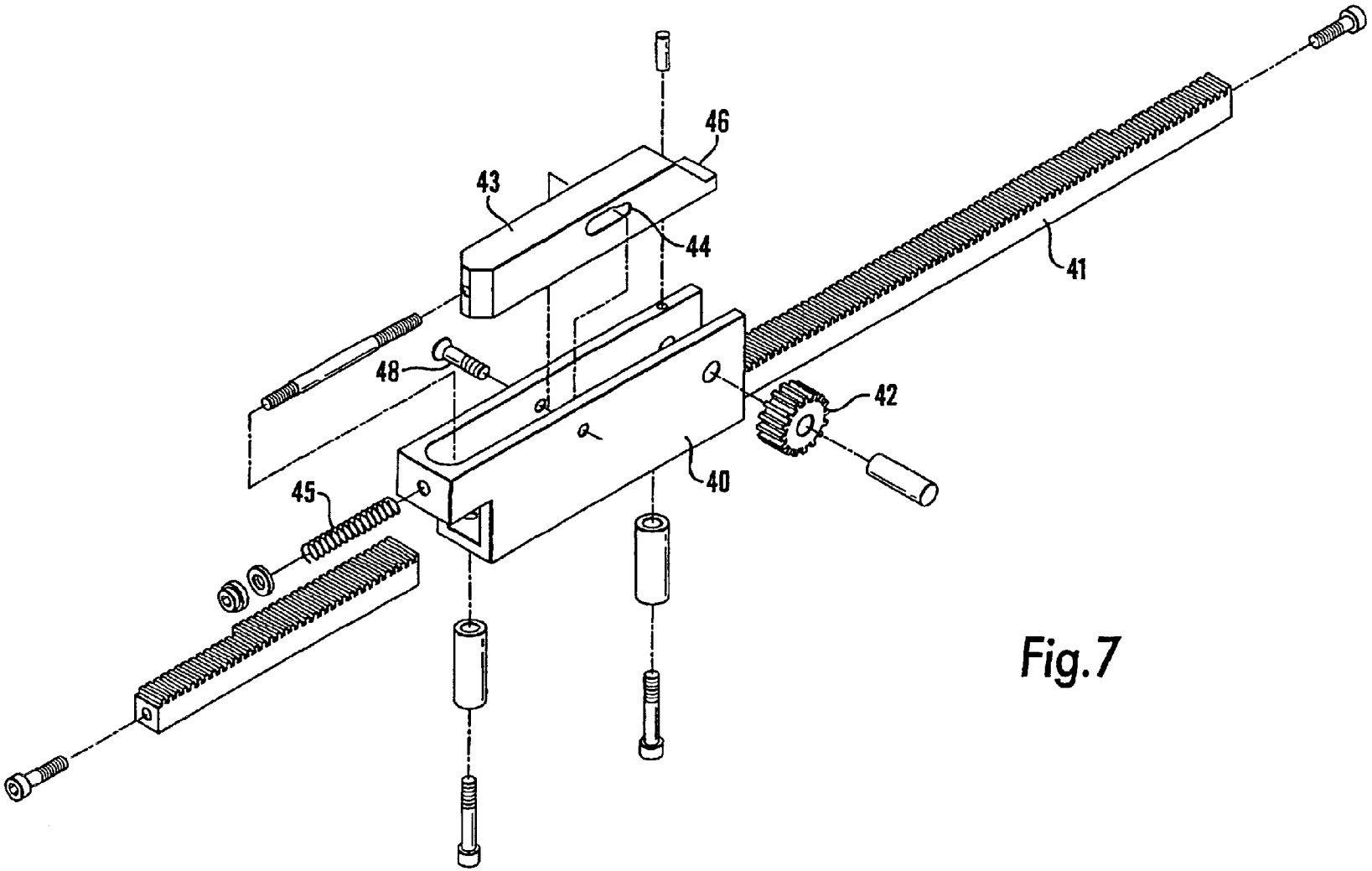
FIG. 7 shows a locking means for automatic locking of the cylinder pistons, if it exceeds a certain speed.
Figure 13:
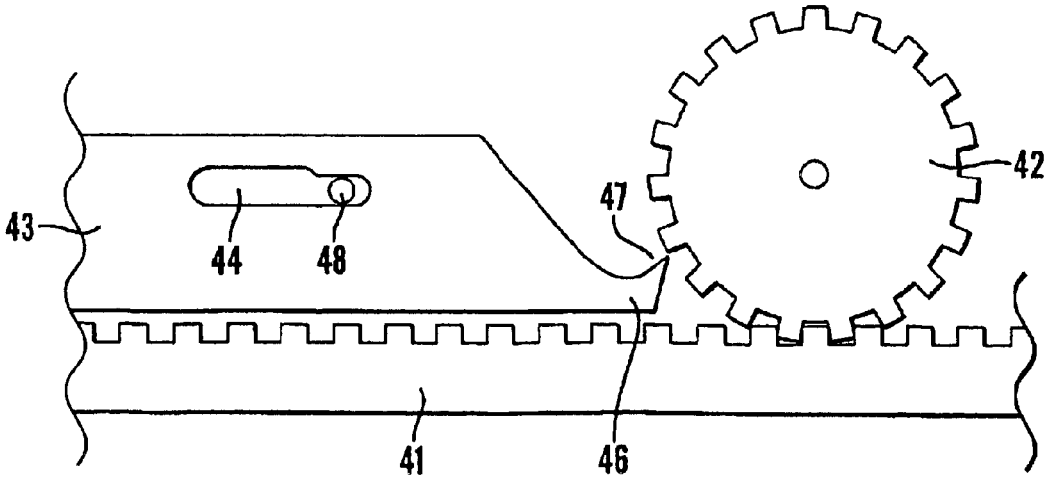
FIG. 13 shows in more detail parts of the locking means of FIG. 7.

With reference to FIG. 2, it is as an example schematically shown how the lifting device may be provided with means to automatically interrupt the lifting, independent of the operator, when a predetermined condition has been fulfilled. A housing 40 is then movably provided along a gear rack 41. This aspect of the invention is more clearly shown in FIG. 7. As can be seen from FIG. 7, there is a catch 43, which is movably mounted in the housing 40, which is movable together with the cylinder pistons. The catch 43 is arranged to move by inertia to a locking position, when the rope/wire and hence also the cylinder pistons accelerate rapidly, so that the acceleration exceeds a predetermined value. The housing 40 is fixedly connected to a movable part of the lifting device, for instance the pulling element 15, shown in FIG. 2, or the cross bar 4, shown in FIG. 1, to a part being fixedly connected to the pulling element 15 or the cross bar 4, or to another part of the cylinder assembly moving together with the cylinder pistons/cylinder piston. The mounted housing 40 then follows the motion performed by the cylinder piston. The housing 40 is arranged to move over the gear rack 41 interacting with the gearwheel 42, which is rotatably journalled in the housing 40. The gear rack 41 is fixedly connected to a stationary part, e.g. the basic element 2 shown in FIG. 1. Alternatively the gear rack can be fixedly connected to the rear and front, respectively, end piece 60, 61 of the cylinder 1, as is indicated in FIG. 2. The catch 43 is movably mounted in the housing 40 by a slit 44 in the catch 43 being used to mount the catch 43. At normal drive, a compression spring 45 keeps the catch 43 in its ready position. If a luggage handle breaks, the housing 40 will accelerate. The catch 43 will then, because of the inertia, slide relative the housing 40 in the slit 44 and rapidly move forwards against the cogs. A small part 46 of the catch 43, e.g. a blade shaped part 46, at the end of the catch 43 facing against the gear rack 42 will then wedge between the cogs of the gear rack 41 and the gear wheel 42, whereby the cogs will be locked, so that the housing 40 will get stuck in its position and the wire or rope 7 stops moving. Thus, as is shown in FIG. 13, the small part 46 of the catch 43 can end with an upwardly directed tooth 47 for engagement with the gear wheel 42. If a luggage handle breaks, the lifting motion will therefore automatically stop, when a predetermined condition has been fulfilled concerning the acceleration of the rope 7 and hence also the housing 40, namely when the speed increase of the housing 40 exceeds a certain limit. As can be seen from FIG. 7 and FIG. 13, the catch 43 is slidable in the slit 44 through a shaft journal 48 mounted in the housing, which journal runs through the slit 44. It might also be conceivable to act the other way round and place the slit 44 in the housing 40. However, it is preferred that the slit 44 is placed in the catch 43.

Figure 8A:
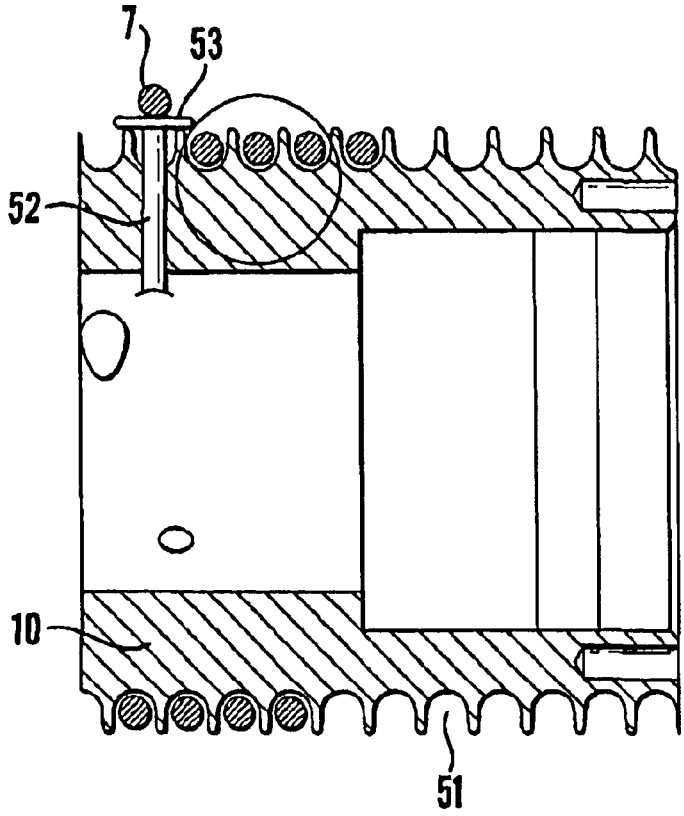
FIGS. 8*a* and 8*b* show a design of a rope drum suitable for use in the lifting device of the invention.
Figure 8B:
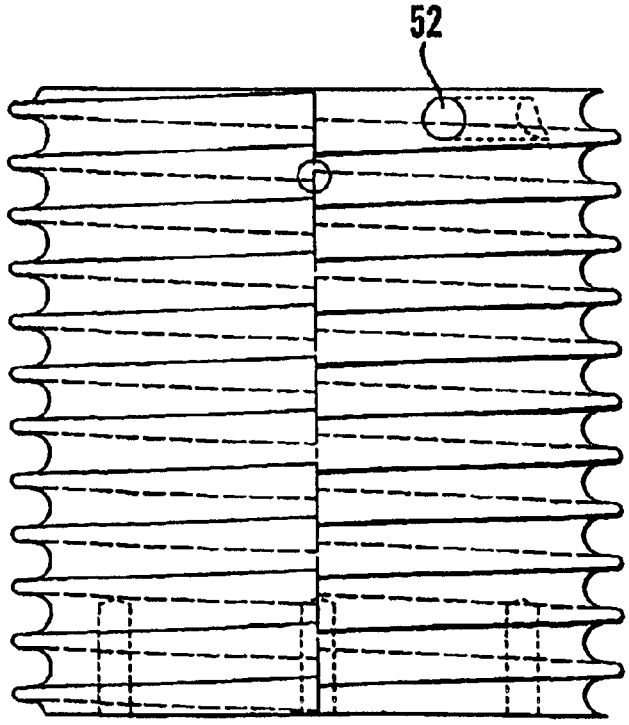
Figure 9:
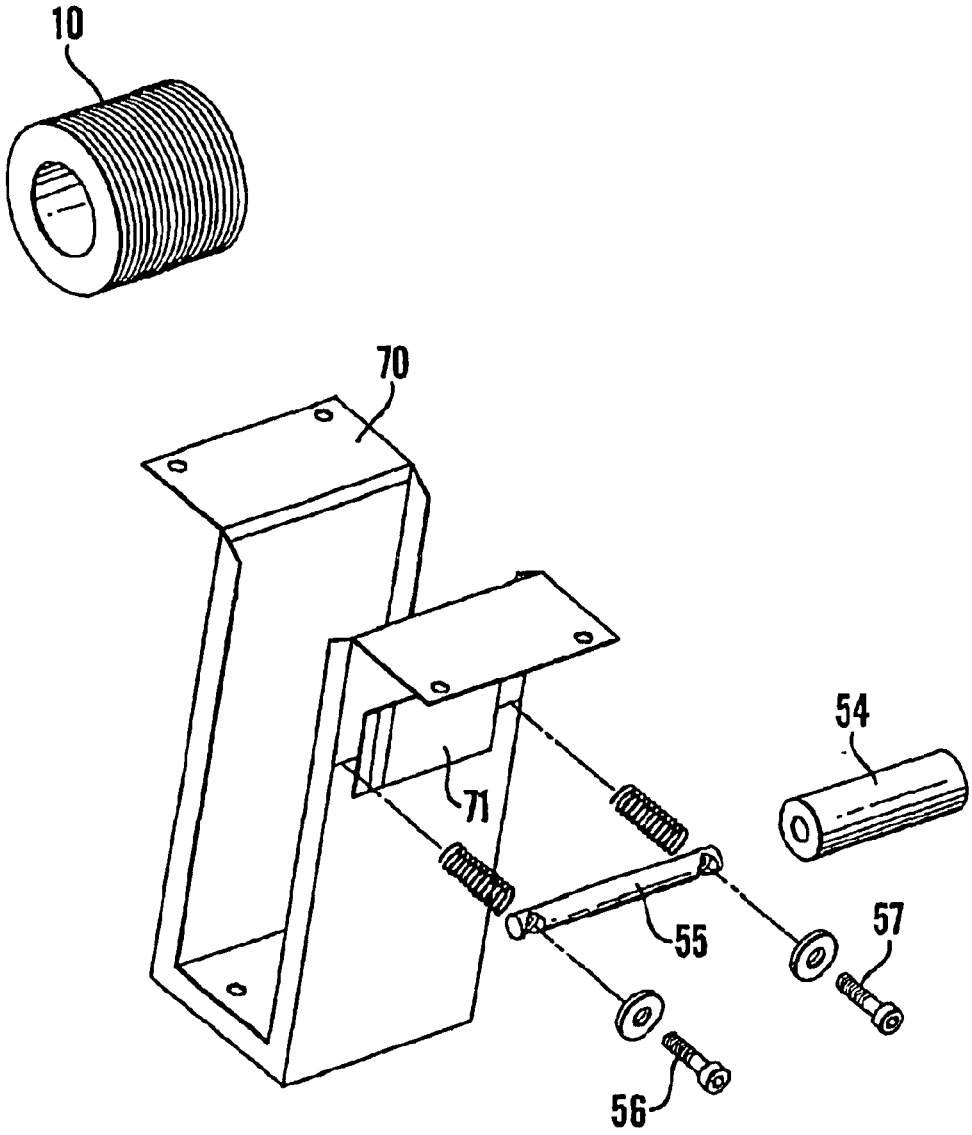
FIG. 9 shows in a perspective view the structure of a means for automatically interrupting the lifting on the lifting device, when the rope or wire has reached a certain position, or when the rope runs off.
Figure 10:
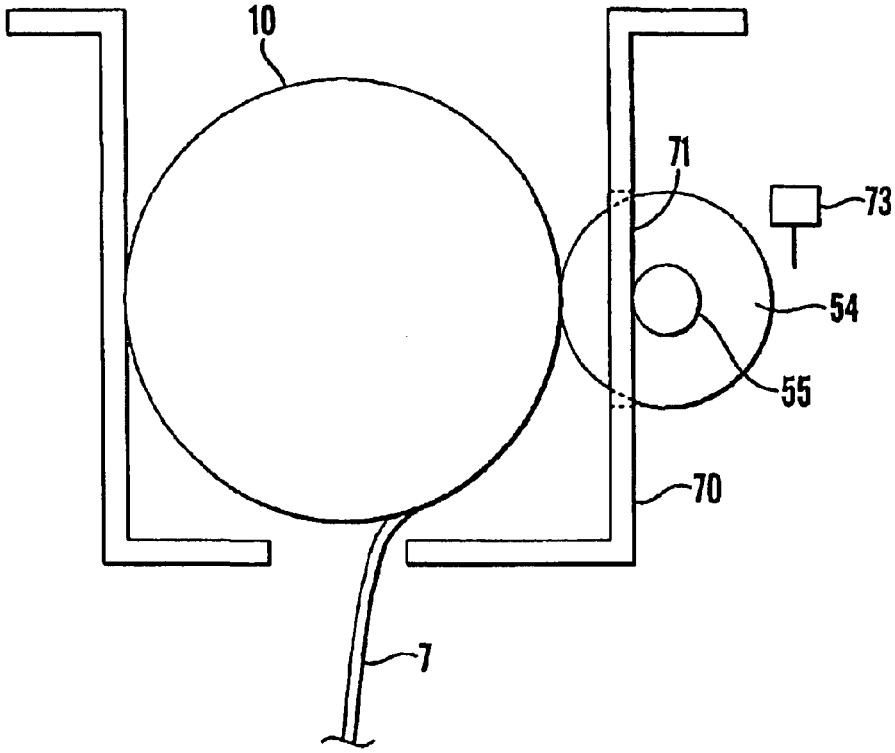
FIG. 10 shows the same thing as FIG. 9 from another perspective.
Figure 11:
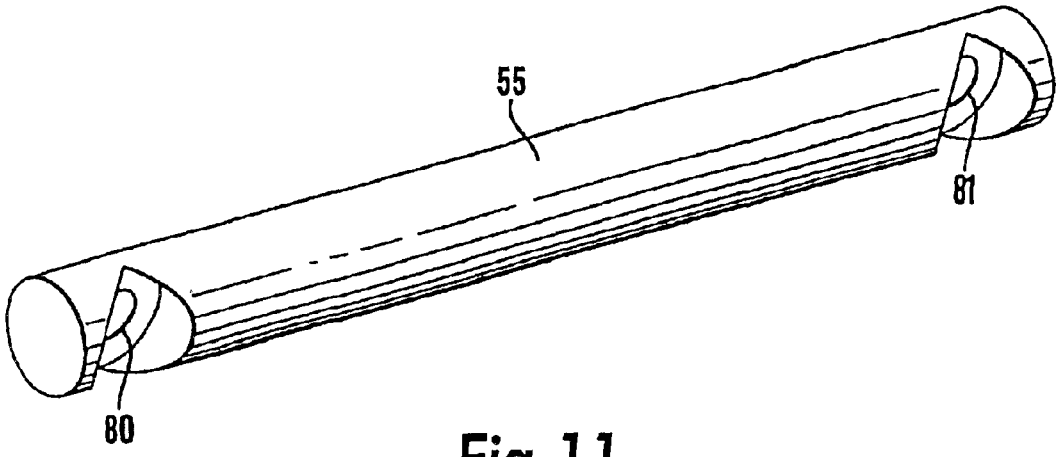
FIG. 11 shows a detail from FIG. 9.
Figure 12:
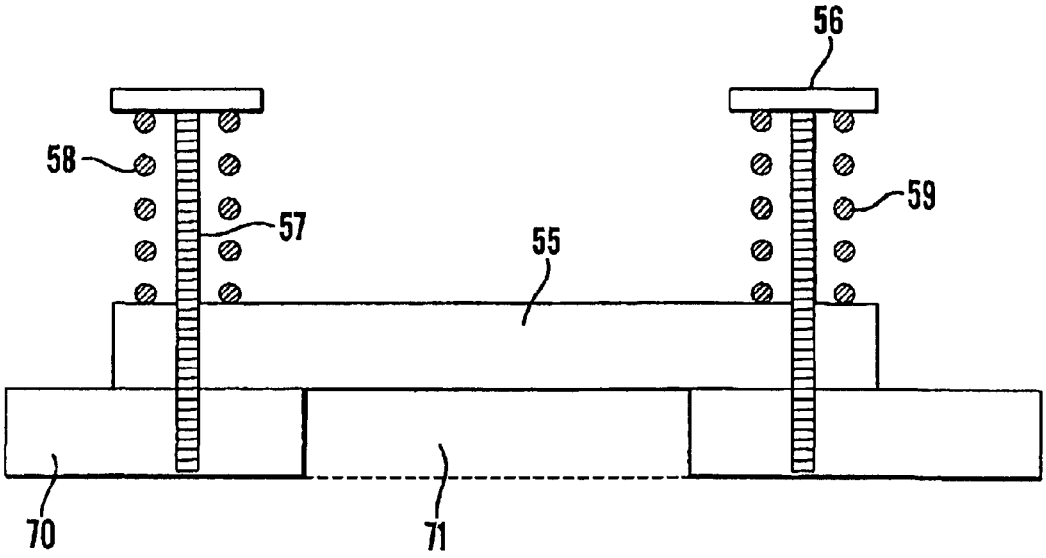
FIG. 12 shows the attachment of the detail shown in FIG. 11.

In FIGS. 8 to 12, it is in an additional example shown how the lifting device may be provided with means to automatically interrupt the lifting, independently of the operator, when a predetermined condition has been fulfilled. In FIG. 8 it is shown that a rope wheel 10, around which the rope is wound at lifting, is provided with grooves 51 for the rope 7. A raised screw 53 has been inserted in an aperture 52. When a sufficiently large amount of the rope 7 has been wound on the rope wheel 10, the rope will reach the raised screw 53. The rope will then be lifted onto the raised screw 53. As can be seen from FIG. 9 and FIG. 10, the rope wheel 10 is mounted in a casing 70 with an opening 71. A press roller 54 is journalled on an axis 55 mounted in the opening 71. As is schematically shown in FIG. 11, the axis 55 is provided with through holes 80, 81. The axis 55 is attached to the casing 70 through the holes 80, 81 by means of bolts or screws 56, 57, which is shown in FIG. 12. The bolts or screws 56, 57 have a diameter which is smaller than the holes 80, 81, so that the axis 55 can be moved outwardly from the casing 70. To keep the axis 55 against the casing 70, resilient means 58, 59 are provided between the axis 55 and the screw or bolt heads, so that the axis 55 is pressed against the casing 70 by the resilient means 58, 59. The resilient means 58, 59 are suitably helical springs. Reference is now made to FIG. 10. If the rope 7 is lifted by the raised screw 53, the rope will turn against the press roller 54, as said roller is journalled with its outer surface close to the rope wheel 10. The press roller 54 is then exposed to an outward pressure, which is propagated to the axis 55, on which the press roller 54 is journalled. The axis 55 and the press roller 54 are then moved outwardly by the force from the resilient means 58, 59. Then the press roller 54 will travel against a micro switch 73, whereupon the current is broken and the lifting operation stops.

The rope drum 10 can advantageously be journalled against a gear box axis with a bearing which only engages at lifting motions—at lowering motions the rope drum is released. This permits the operator to lower the rope with unloaded handle while the handle is brought upwards and is kept in an unchanged position. The operator can thereafter pull down the rope 7 in a realeased position, which results in a practical and reliable working process. According to a suitable embodiment of the invention, the rope drum can have a conic shape. If a small diameter of the rope drum is used at the beginning of the lifting operation, then a lower start speed of the lifting motion is obtained, which motion successively increases to a higher normal speed while the turning moment will be larger in the starting phase. Also a smoother lowering is obtained when the rope drum has a conic shape.

The invention can be varied in different ways within the scope of the patent claims. Thus, it is conceivable to use only one hydraulic cylinder in the first embodiment, should this be suitable. It should be understood, that the device advantageously can be provided with control/adjustment functions, which can be individually adopted to the requirements of different customers. For instance, it is possible to install functions in the control unit (preferably in the form of a software), which ensures smooth starting motions and stop motions, respectively, so that possible detrimental jerks (which can be negative both for the lifting device and the goods) are eliminated. Such a function also implies a minimizing of possible risk of damage in connection with a handle getting loose from a suitcase, for instance. In such a situation, the wire/rope could otherwise flick, which may result in personal injury. Further, it should be understood that the invention must not necessarily be used together with a hook 8 but that other types of lifting means of course also can be used, which are adopted to the type of goods to be lifted. For instance, lifting means can be used, which act through vacuum, e.g. suction cups. A lifting device acting through suction cups can be suitable for lifting disc-shaped goods. As the lifting device is provided with means to automatically interrupt the lifting operation, independent of the operator, when a predetermined condition has been fulfilled, the advantage is obtained that rapid jerks can be avoided, which also contributes to eliminating leakage because of wear of the seals.

According to a particularly suitable embodiment of the invention, the lifting device comprises, as explained above, a pulling device which is so designed that the rope, when it is pulled up, occupies a considerably shorter length than the distance which the lifting device has been lifted. Within the scope of the invention embodiments are conceivable where this is not the case. Within the scope of the invention, means may for instance be used to automatically interrupt the lifting, independent of the operator, without the rope, when it is wound, occupying a shorter length than the distance which the gripping device has been lifted.

What is claimed is:

1. A lifting device comprising:

a rope or wire provided at one end with a gripping device for an object to be lifted;

a pulling device provided at the other end of said rope or wire;

a rope wheel with a groove around which the rope or wire is wound, said rope wheel having a bulge;

wherein, when the rope is wound on the rope wheel and reaches the bulge, the rope is lifted and interacts with a breaker whereby lifting is stopped.

2. A lifting device according to claim 1, wherein the gripping device is a hook with an operating handle for lifting and lowering the hook.

3. A lifting device according to claim 2, wherein the operating handle includes valves for the hydraulic and pneumatic operation, respectively, or electric adjustment means, or a transmitter for control of the pulling device.

4. A lifting device according to claim 1, wherein the pulling device includes at least one pneumatic or hydraulic cylinder having first and second end walls, wherein said first end wall is attached to a carrier to which is attached a first fiddle block, wherein said cylinder through its piston rod extending from said second end wall supports a second fiddle block, which via the rope interacts with said first fiddle block attached to the carrier.

5. A lifting device according to claim 1, wherein the pulling device is an electric motor which drives said rope wheel.

6. A lifting device according to claim 1, wherein the pulling device is an origo cylinder having an endless belt on which an impeller is arranged, which, via the rope or wire, interacts with a fixed impeller at the cylinder to shorten or lengthen the rope or wire.

7. A lifting device according to claim 1, wherein the rope wheel is provided with an aperture.

8. A lifting device according to claim 1, wherein the rope interacts with the breaker via a movable press roller.

9. A lifting device according to claim 1, wherein the lifting device is suspended in a system of rails which enables horizontal movement of the lifting device in an optional direction.

10. A lifting device according to claim 1, wherein said rope has a length of 1 to 5 meters.

11. A lifting device according to claim 1, wherein said rope has a length of 1 to 3 meters.

12. A lifting device according to claim 1, wherein said rope wheel is provided with an aperture in which a raised screw is inserted.

13. A lifting device comprising:

a rope or wire provided at one end with a gripping device for an object to be lifted;

a pulling device provided at the other end of said rope or wire, said pulling device including at least one pneumatic or hydraulic cylinder having first and second end walls, said first end wall being attached to a carrier, said cylinder having a piston rod extending from said second end wall;

a catch mounted in a means movable together with the piston rod and adapted to move by inertia to a locking position when the rope and the piston rod accelerate with an acceleration which exceeds a predetermined value.

* * * * *